US005421314A

United States Patent [19]

Kidney

[11] Patent Number: 5,421,314

[45] Date of Patent: Jun. 6, 1995

[54] QUICK SET REST

[76] Inventor: Charles C. Kidney, 201 Old Batson Rd., Taylors, S.C. 29687

[21] Appl. No.: 104,351

[22] Filed: Aug. 9, 1993

Related U.S. Application Data

[63] Continuation-in-part of Ser. No. 13,928, Feb. 5, 1993.

[51] Int. Cl.[6] ..... F41B 5/00

[52] U.S. Cl. ..... 124/44.5; 124/24.1

[58] Field of Search ..... 124/44.5, 41.1, 80, 124/24.1, 22

[56] References Cited

U.S. PATENT DOCUMENTS

| | | | |
|---|---|---|---|
| 3,517,657 | 6/1970 | Alban . | |
| 3,871,352 | 3/1975 | Stanislawski et al. | 124/41.1 |
| 3,919,997 | 11/1975 | Day | 124/44.5 |
| 3,935,854 | 2/1976 | Troncosco, Jr. . | |
| 4,344,409 | 8/1982 | Barner . | |
| 4,686,956 | 8/1987 | Troncoso, Jr. | 124/44.5 |
| 4,809,669 | 3/1989 | Saunders | 124/44.5 |
| 5,117,803 | 6/1992 | Johnson . | |
| 5,190,023 | 3/1993 | Sacco | 124/44.5 |

OTHER PUBLICATIONS

Bowhunters' Discount Warehouse Inc., catalog, Summer Edition, 1992, pp. 24 and 25.

*Primary Examiner*—Randolph A. Reese
*Assistant Examiner*—Anthony Knight
*Attorney, Agent, or Firm*—Henry S. Jaudon; Cort Flint

[57] ABSTRACT

The invention is directed to an arrow support and the method of adjusting the gap between the arrow support pods which supports the arrows for launch. The support is made from spring steel which has discrete sections thereof made malleable by heating. The malleable sections allow the support pods to be compressed toward each other to form a gap of less than the desired width. The arrow is then drawn through the gap to properly space the pods.

15 Claims, 2 Drawing Sheets

QUICK SET REST

This is a continuation in part of application Ser. No. 08/013/928, filed Feb. 5,1993, now pending.

BACKGROUND OF THE INVENTION

The present invention is directed to an arrow support of an arrow rest adapted for use with an archer's bow, preferably an archer's compound bow. The arrow support is designed for easy, quick and yet extremely accurate adjustment of the arrow support pods with individual arrows.

The prior art consist of numerous designs for arrow rests such as those shown on pages 24 and 25 of *Bowhunters' Discount Warehouse, Inc.* catalog, Summer edition, 1992. Each of these arrow rests is designed to be mounted with a bow. Each includes an arrow launcher. Each possesses adjustment arrangements where the arrow launcher may be adjusted for its vertical position and its horizontal position relative to the bow. Many include arrow support fingers in which the gap separating the support pods is adjustable. Each contains the singular drawback which the arrow rest of the present invention is designed to eliminate, i.e. the adjustment of the gap separating the pods can not be made instantaneously without loosening and tightening adjustment screws.

Accordingly, it is an object of this invention to provide an arrow support which is easily and accurately adjusted for use with different arrows.

Another object of the invention is to provide an arrow support in which the gap adjustment may be made with the support in position on the arrow rest.

Another object of the invention is to provide a method of adjustment for an arrow support of an arrow rest.

Another object of the invention is to provide an arrow support constructed to allow an arrow to launch in silence.

Another object of the invention is to provide a kit containing apparatus which enables the arrow support to launch an arrow in silence and also provides for re-conditioning of this apparatus.

SUMMARY OF THE INVENTION

The invention is directed to an adjustable arrow support for use with an arrow rest of an archery bow. The arrow support is formed to have a pair of fingers or prongs arranged along substantially a single plane, first ends of the prongs are in spaced manner to support an arrow. The opposite ends of the prongs are secured to a support rod. The prongs are formed of spring steel and are constructed to have a malleable portion which allows the first ends to be precisely adjusted at a desired spacing. The second ends of the prongs are secured to the rod by means of a weld. The malleable portion is formed adjacent to the weld.

The second ends of the prongs are secured with the support rod in spaced manner with the prongs arranged substantially transverse of the rod inclined inwardly toward their first ends.

The prongs of the arrow rest are coated with titanium nitrite or chromium nitrite for increased wearability. Alternately, the prongs are coated with an epoxy or an urethane resin to provide silence during launching.

Arrow support pods are formed at the first ends of the prongs by shaping these ends so that the terminating portions thereof extend substantially perpendicularly thereof. Because the pods are formed by cold working the end portions, the spring steel forming them is of a greater hardness than the steel forming the remainder of the support.

Another arrangement for the first ends of the prongs is to encase them with latex tubing and to then coat the tubing with an epoxy lacquer. This structure provides for a silent launch.

A kit is provided for use with the arrow support. The contents of the kit are adapted to provide for a silent arrow launch. The kit includes a plurality of latex tubes adapted to fit over at least the first ends of the prongs of the arrow support. Also, included are a plurality of vials of lacquer which are used to coat the exterior surface of the latex tubes and a brush for each of the vials to apply the latex onto the tubes. The kit allows the archer to re-coat the tubes during a hunt should the lacquer become chipped or worn.

A method for quickly and accurately adjusting the gap separating the arrow support pods of an arrow support. The method includes urging the pods together so that a gap which is too small is created. The arrow is inserted into the space below the gap and is then drawn upwardly through the gap. Movement of the arrow through the gap separates the pods to an exact adjustment.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The instant invention which is shown in the accompanying drawings, is directed to an arrow rest A which includes arrow support C for use with an archer's bow B. Bow B may be any type, however, arrow rest A is most preferably used with a compound bow.

Figure 1:
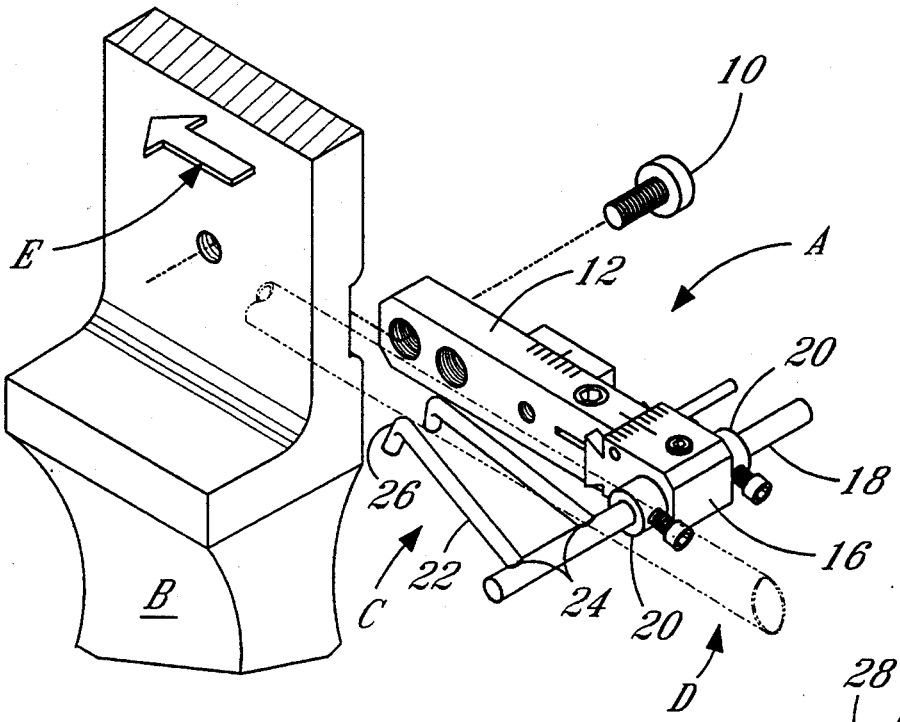
FIG. 1 is a sectional perspective view, from the left side of the arrow support of the invention connected with an arrow rest.

Turning now to FIG. 1, arrow rest A can be seen as mountable with bow B by securing bolt 10 which passes through a selected of the pair of apertures in mounting block 12 and is threadably engaged with the opening shown in the riser of the bow to secure the block therewith. Mounting block 12 mounts slide block 16 at one end thereof. Slide block 16 is arranged for transverse adjustment of block 14. An arrow support C is pivotally carried by slide block 16 and is resiliently held in position to support arrow D for launching in the direction indicated by arrow E. This entire arrangement is described in complete detail in the earlier referred to copending U.S. application Ser. No. 08/013,928.

Figure 2:
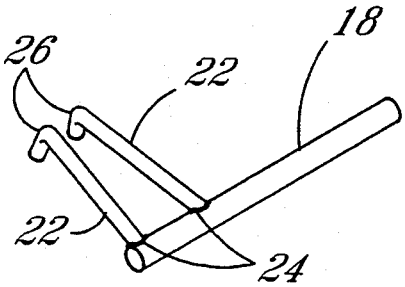
FIG. 2 is an perspective view of the arrow support of the invention.

Viewing now FIGS. 1 and 2, arrow support C consists of a support shaft 18 which passes through a bore in block 16 and is held in position by clamps 20. A pair of prongs or fingers 22, which have been shaped at one end to form arrow support pods 26, are secured at their opposite ends to shaft 18. These secured end portions of prongs 22 are arranged in spaced relationship and are secured to shaft 18 by welds 24. The longitudinal axes of prongs 22 and shaft 18 are arrange to extend along substantially a single plane. Prongs 22 project angularly outwardly from the longitudinal axis of shaft 18 so that adjacent ends which form arrow support pods 26 are more closely spaced from each other than the opposite ends at welds 24. The gap formed between adjacent pods 26 is of controlled size. Normally arrow support pods 26 are arranged to extend substantially perpendicularly of prongs 22 and in position to support with their upper surfaces the shaft of arrow D.

Prongs 22 are formed of cold drawn spring tempered stainless steel. Preferably shaft 18 is also formed of spring tempered stainless steel although this is not necessary to the invention and the shaft could be formed of any stainless steel. The preferred spring tempered stainless steel is the AISI or ASTM stainless 300 series with the AISI 302 being the preferred metal. The following chart sets forth a variety of metals which may be utilized to form the arrow support of the invention. In order to improve the appearance of the arrow rest and improve wearability it may be desirable to apply a coating of titanium nitrite or other similar materials. The coating may completely cover the prongs or be restricted to the ends.

When forming arrow rest C, the pods 26 are formed by bending the upper ends of prongs 22. This procedure is referred to as cold working the metal and results in the pods becoming harder and more resistant to bending and wear. The opposite ends of prongs 22 are secured to shaft 18 by welding which heats this portion of the prongs. This heating during welding causes some of the resilience or elasticity in the end portions of the spring tempered stainless steel prongs to be lost. The heated end portions are actually affected to a degree that they become slightly malleable or a malleable area is formed at that end of prongs 22.

Figure 4:
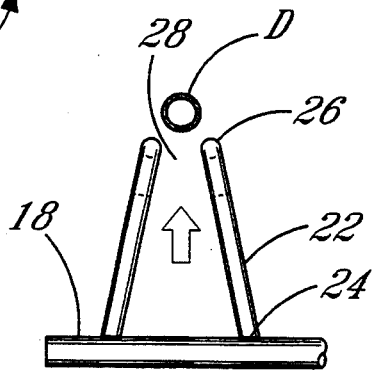
FIG. 4 is a side view of an arrow support showing the arrow in position after having adjusted the gap.
Figure 3:
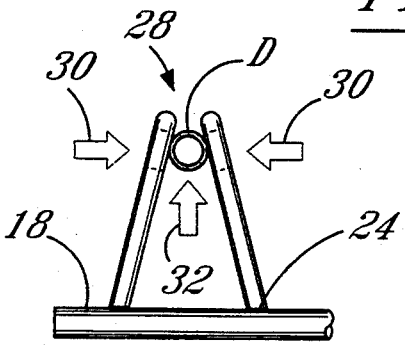
FIG. 3 is a side view of the arrow support showing an arrow in position to adjust the gap of the arrow support pods.

The method of adjusting the gap between pods 26 is best shown in FIGS. 3 and 4. Inward pressure is applied to pods 26 to urge then toward each other in the direction of arrows 39 so that gap 28 is made smaller than the diameter of arrow D. With gap 28 so diminished, arrow D is placed in the opening below the upper surface of pods 28. Arrow D is then moved upwardly or in the direction of arrow 32 to engage the upper ends of prongs 22 as it is forced between gap 28. As arrow D passes between pods 26, prongs 22 are urged slightly outwardly. The resilience of the stainless steel causes prongs 22 to slightly spring back to their original position thus forming gap 28 to be slightly less than the diameter of arrow D. This position places pods 26 within one and three thousands of an inch of the perfect spacing for the proper launching of an arrow.

While the method of adjusting gap 28 is both efficient and accurate, it is also quick and is done without tools.

It is noted that all arrows of a particular model and make are usually all of the same diameter. It is when there is a change between makes and or models of arrows that adjustment is necessary. Also, wear of the arrow shaft and to a lesser degree the pods can necessitate an adjustment of the pod setting.

Figure 5:
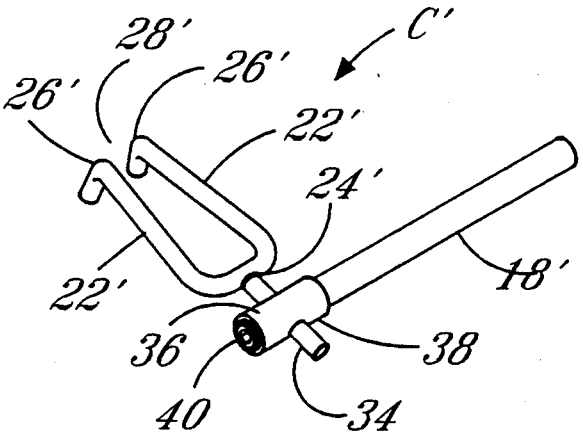
FIG. 5 is a perspective view of an alternative arrow support structure.

An alternative of the invention is shown in FIG. 5. In this arrangement arrow rest C′ consist of shaft 18 having one end 36 formed with a bore 38 interrupted with

| | Material | Tensile Properties Modulus of Elasticity E psi × $10^4$ {MPa × $10^3$} | Torsional Properties Modulus in Torsion G psi × $10^4$ {MPa × $10^3$} | Maximum Operating Temperature °F. | °C. | Rockwell Hardness | Method of Manufacture Chief Uses Special Properties |
|---|---|---|---|---|---|---|---|
| High Carbon Spring Wire | Music Wire ASTM A 228 | 30 (207) | 11.5 (79.3) | 250 | 121 | C41-60 | Cold Drawn |
| | Hard Drawn ASTM A 227 | 30 (207) | 11.5 (79.3) | 250 | 121 | C31-52 | Cold Drawn |
| | High Tensile Hard Drawn ASTM A 679 | 30 (207) | 11.5 (79.3) | 250 | 121 | C41-60 | Cold Drawn |
| | Oil Tempered ASTM A 229 | 30 (207) | 11.5 (79.3) | 250 | 121 | C42-55 | Cold Drawn |
| | Carbon Valve ASTM A 230 | 30 (207) | 11.5 (79.3) | 250 | 121 | C45-49 | Cold Drawn |
| Alloy Steel Wire | Chrome ASTM A 231 | 30 (207) | 11.5 (79.3) | 425 | 218.5 | C41-55 | Cold Drawn |
| | Chrome Silicon ASTM A 401 | 30 (207) | 11.5 (79.3) | 475 | 246 | C48-55 | Cold Drawn |
| Stainless steel Wire | AISI 302/304 ASTM A 313 | 28 (193) | 10 (69.0) | 550 | 228 | C35-45 | Cold Drawn |
| | AISI 316 ASTM A 313 | 28 (193) | 10 (69.0) | 550 | 288 | C35-45 | Cold Drawn |
| | 17-7 PH ASTM A 313 (631) | 29.5 (203) | 11 (75.8) | 650 | 343 | C38-57 | Cold Drawn |
| Non-Ferrous Alloy Wire | Phosphor Bronze Grade A ASTM B 159 | 15 (303) | 6.25 (43.1) | 200 | 93.3 | B9B-104 | Cold Drawn |
| | Beryllium Copper ASTM B 197 | 18.5 (128) | 7.0 (48.3) | 400 | 204 | C35-42 | Cold Drawn |

a lock screw 40 arranged in the end of shaft 18. Prongs 22' are arranged continuous in the form of a U with pods 26' formed at their respective ends. The intermediate portion of prongs 22' is secured with rod 34 by means of weld 24'. Rod 30 is received in bore 38 and screwed in position by lock screw 40. Weld 24' causes that portion of prongs 22' adjacent to rod 30 to become annealed and slightly malleable. Arrow support C' functions with arrow rest A in the same manner as already described for support C. The gap 28' is adjusted in the manner already described for the adjustment of gap 28.

Figure 6:
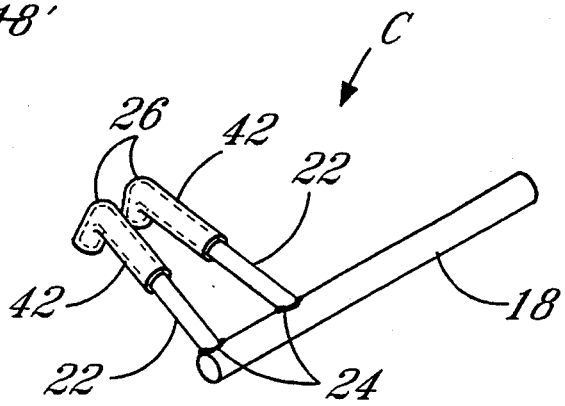
FIG. 6 is a perspective view of the arrow support of the invention in which tubes have been arranged over the ends of the prongs.
Figure 7:
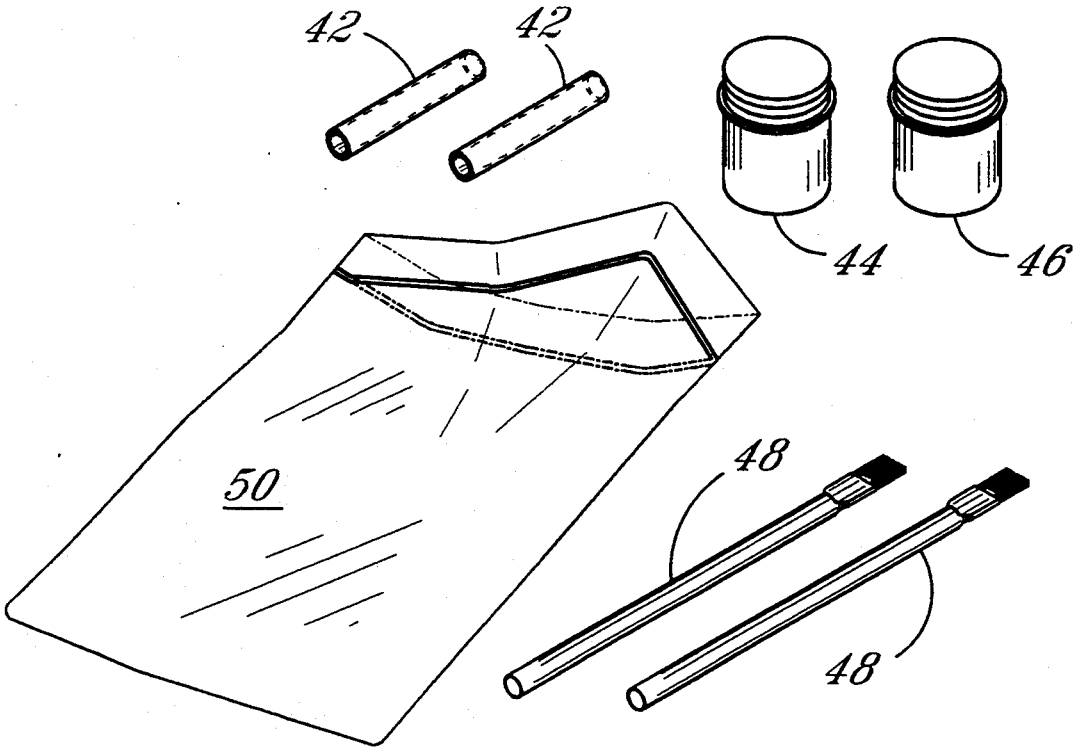
FIG. 7 is a perspective view of a kit adapted for use with the arrow support of the invention.

An additional embodiment is shown in FIG. 6. Arrow rest C is constructed as in FIGS. 1 and 2 to include shaft 18 to which prongs 22 are secured by welds 24. Pods 26, shown in broken lines, are covered latex tubes 42 which fit snugly thereon. Tubes 42 may be painted with a silicone or urethane lacquer to produce a hard and substantially frictionless outer surface over which arrows slide during launch. Coated tubes 42 are primarily provided for use by hunters as they allow arrows D to be launched in substantially complete silence.

An adapter kit which includes clear plastic bag 50, a pair of latex tubes 42, a container of silicone lacquer 44, a container of urethane lacquer 46 and a pair of applicator brushes 48 may be provided for use with arrow support C. The kit is intended for use while hunting and is adapted to make the arrow rest operative to provide a silent arrow launch. If the lacquer becomes worn or chipped the kit provides a means to repair the arrow support in the field.

Another method of providing silent arrow launch is to coat the upper ends of prongs 22 to include pods 26 with an epoxy or urethane resin.

To increase the wearability of the arrow support, the upper ends of prongs 22 to include pods 26 may be coated with titanium nitrite or chromium nitrite.

While a preferred embodiment of the invention has been described using specific terms, such description is for illustrative purposes only, and it is to be understood that changes and variations may be made without departing from the spirit or scope of the following claims.

What is claimed is:

1. An adjustable arrow support for use with an arrow rest of an archery bow;

said arrow support having a pair of prongs arranged along substantially a single plane, first ends of said prongs are arranged in spaced manner to support said arrow on upper surfaces thereof and second ends of said prongs are secured to a support rod;

said prongs being formed of spring steel;

said prongs including a malleable portion adjacent said second ends; and said prongs having means for allowing said malleable portions to be shifted relative to each other such that said first ends can be precisely adjusted to a desired arrow supporting position by placing an arrow shaft adjacent said support rod between the prongs and pulling the arrow shaft upwardly to cause the prongs to separate to the desired supporting position.

2. The support of claim 1 wherein said second ends are secured to said rod by means of a weld.

3. The support of claim 2 wherein said malleable portion of said prongs is adjacent said weld.

4. The support of claim 1 wherein, said second ends of said prongs are secured transverse of said support rod in spaced manner with said prongs inclined inwardly toward said first ends along substantially a single plane.

5. The support of claim 1 wherein, said second ends of said prongs are secured with said rod so that said prongs and said rod are disposed in substantially a single plane.

6. The support of claim 1 wherein, at least said prongs are coated with one of titanium nitrite and chromium nitrite.

7. The support of claim 1 wherein, at least said prongs are coated with one of an epoxy and urethane resin to provide silence during launching.

8. The support of claim 1 wherein, said first ends are shaped so that terminating portions thereof extend substantially perpendicularly of said prongs forming arrow support pods.

9. The support of claim 1 wherein, said prongs and said support rod are formed of the same material.

10. The support of claim 1 wherein, said first ends are encased with latex tubing.

11. The support of claim 10 wherein, said latex tubing is coated with an epoxy lacquer.

12. A method of adjusting arrow support pods of an arrow support into relative spaced positions which provide desired supporting contact with a shaft of an arrow, said arrow support being adapted for use with an arrow rest of an archery bow, said arrow support comprising;

support rod mounting a pair of prongs, said prongs being secured at one end in spaced manner to said support rod and arranged to extend inwardly towards a second end, said arrow support pods are formed on said second end, said method comprising;

urging said arrow support pods and said second ends into a position which creates a gap between said arrow support pods of less width than the diameter of said shaft of said arrow;

placing said arrow between said prongs and below said arrow support pods;

drawing said arrow upwardly so that said shaft passes through said gap causing said pods to move into said relative spaced positions which provide said desired supporting contact.

13. A kit for use with an arrow rest the contents of which are adapted to provide a silent arrow release, said arrow rest includes an arrow support having a pair of prongs, said kit including:

a plurality of latex tubes adapted to fit over said prongs of said arrow support;

a plurality of vials of lacquer adapted to be coated onto the exterior surface of said latex tubes; and, an individual brush for use with each of said plurality of vials to apply said lacquer onto said tubes.

14. The device of claim 13 wherein said kit includes a unitary arrow support formed of stainless spring steel.

15. The device of claim 14 wherein said kit includes a transparent bag in which said tubes, said vials, said brushes and said support are contained.

* * * * *